United States Patent [19]

Kato et al.

[11] 4,426,568

[45] Jan. 17, 1984

[54] GLOW PLUG FOR DIESEL ENGINES

[75] Inventors: Yoji Kato, Okazaki; Shunzo Yamaguchi, Okazaki; Takeshi Fukazawa, Kariya; Shinichi Saigo, Okazaki, all of Japan

[73] Assignee: Nippondenso Co., Ltd., Kariya, Japan

[21] Appl. No.: 378,391

[22] Filed: May 14, 1982

[30] Foreign Application Priority Data

May 21, 1981 [JP] Japan ..... 56-75765

[51] Int. Cl.[3] ..... F23Q 7/22

[52] U.S. Cl. ..... 219/270; 123/145 A; 219/260; 219/553; 338/303; 361/266

[58] Field of Search ..... 219/260, 267, 270, 523, 219/552, 553; 361/264, 265, 266; 123/145 R, 145 A; 431/262; 338/303, 22 R, 63

[56] References Cited

U.S. PATENT DOCUMENTS

| | | | |
|---|---|---|---|
| 1,281,744 | 10/1918 | Abbott | 338/303 X |
| 1,609,688 | 12/1926 | Briggs | 123/145 A |
| 2,484,544 | 10/1949 | Bennett et al. | 219/270 |
| 2,976,505 | 3/1961 | Ichikawa | 338/22 R |
| 3,239,377 | 3/1966 | Fritts et al. | 338/303 X |
| 3,372,305 | 3/1968 | Mikulec | 219/270 X |
| 3,454,345 | 7/1969 | Dyre | 361/265 X |
| 3,467,812 | 9/1969 | Terrell | 361/266 X |
| 3,875,477 | 4/1975 | Fredriksson et al. | 361/264 |

FOREIGN PATENT DOCUMENTS

| | | | |
|---|---|---|---|
| 53-62947 | 4/1979 | Japan | 219/270 |
| 408917 | 4/1934 | United Kingdom | 123/145 A |

*Primary Examiner*—Volodymyr Y. Mayewsky
*Attorney, Agent, or Firm*—Cushman, Darby & Cushman

[57] ABSTRACT

A glow plug for preheating the combustion chamber of a diesel engine. The glow plug has a heat generating portion and a mounting portion. The heat generating portion is provided with a ceramic central electrode made of an electrically insulating material and provided with at least one spiral screw-thread groove formed in the outer peripheral surface thereof. A ceramic electric resistor serving as a heat generating member is disposed in the groove. The electric resistor is made of TiC or SiC with or without addition of $Al_2O_3$.

3 Claims, 4 Drawing Figures

GLOW PLUG FOR DIESEL ENGINES

BACKGROUND OF THE INVENTION

The present invention relates to a pre-heating plug, i.e. glow plug, for diesel engines.

DESCRIPTION OF THE PRIOR ART

Figure 1:
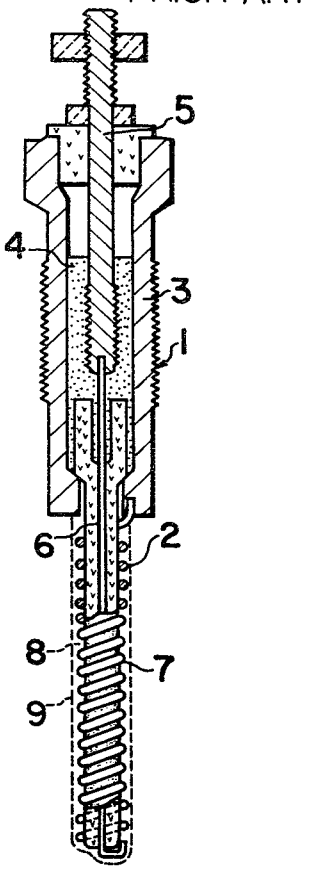
FIG. 1 PRIOR ART
FIG. 1 is a vertical sectional view of a conventional glow plug for diesel engines.

A typical conventional glow plug has a heat generating portion including a heat generating body embedded in a sheath body through the medium of an insulator. A typical example of such a glow plug is shown in FIG. 1. This glow plug has a housing 3 consisting of a mounting portion 1 and a heat generating portion 2 and adapted to be mounted at the mounting portion 1 on the cylinder head of an engine. The glow plug further has a central electrode 9 disposed in the housing 3 through the medium of an insulator 4. The heat generating portion 2 includes a metallic electric resistor 7 wound round a central rod 6 of a ceramic material and fixed in a sheath 9 through the medium of an insulator 8. The electric resistor 7 is connected at its both ends to the central electrode 5 and the housing 3. As electric voltage is applied between the central electrode 5 and the housing 3, electric current flows through the electric resistor 7 to generate heat which in turn is transmitted, through the heat insulator 8, to the sheath 9 to red-heat the sheath 9. Since the transfer of the heat to the sheath 9 is made through the insulator 8, the efficiency of the heat transfer is impractically low and a comparatively long time is required until the sheath is heated up to the desired high temperature. Furthermore, since the resistance member has to be maintained at a sufficiently high temperature, there is a fear that the electric resistor 7 is burnt out. Also, there is a tendency that the metallic sheath member is liable to be corroded and deteriorated.

SUMMARY OF THE INVENTION

Accordingly, an object of the invention is to provide a glow plug for diesel engines improved to overcome the above-described problems of the prior art.

To this end, according to the invention, there is provided a glow plug for diesel engines, having a heat generating portion and a mounting portion, wherein the heat generating portion includes a central rod made of an electrically insulating material and provided in the outer peripheral surface thereof with a spiral groove, and a heat generating body made of a semiconductive material and disposed in the spiral groove.

The above and other objects, features and advantages of the invention will become clear from the following description of the preferred embodiments taken in conjunction with the accompanying drawings.

Figure 2A:
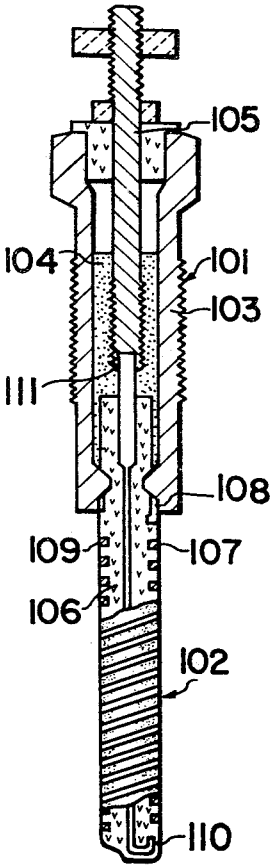
FIG. 2*a* is a vertical sectional view of a glow plug for diesel engines, constructed in accordance with an embodiment of the invention.
Figure 2B:
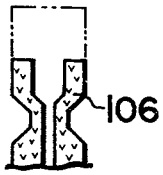
FIG. 2*b* is an enlarged sectional view of a portion of the plug shown in FIG. 2*b.

A glow plug in accordance with a first embodiment of the invention will be described hereinunder with reference to FIGS. 2*a* and 2*b*. The glow plug of the first embodiment has a mounting portion 101 and a heat generating portion 102. The mounting portion 101 includes a housing 103 by means of which the glow plug is mounted on a head cover of a cylinder of the engine, and a central electrode 105 fixed in the housing 103 through an insulator 104.

The heat generating portion 102 has a central rod 106 which extends downwardly from the lower end of the housing 103 coaxially with the latter. A single screw-thread groove 109 of a suitable pitch is formed in the peripheral surface of the central rod 106. An electric resistor 107 made of a semiconductive material such as a ceramic material is disposed in the groove 109. The ceramic central rod 106 is made of alumina which is chemically stable enough to avoid any oxidation or deterioration even in oxidizing atmosphere of high temperature. On the other hand, the ceramic electric resistor 107 is made of TiC or SiC. As an additional material, it is possible to add $Al_2O_3$ to the material mentioned above. This ceramic electric resistor 107 can stably generate heat at the surface thereof. The electric resistor 107 is connected at its upper end 108 to the housing 103. The resistor 107 is extended from its lower end 110 upwardly through the ceramic central rod 106 along the axis of the latter, and is connected at its upper end 111 to the central electrode 105 by means of a silver paste.

A preferred method of forming the heat generating portion 102 will be explained, although the same can be formed by other suitable methods. A granular material is formed by adding polyvinyl alcohol as a binder to the powder of $Al_2O_3$ (alumina). A rod-shaped member is formed by a press with this granular material. This rod-shaped material has a size about 20% greater than that of the final size of the ceramic central rod 106. This rod-shaped member is temporarily fired in an electric furnace and the spiral screw-thread groove 109 is formed in the fired peripheral surface by means of a lathe. Then, a granular material is prepared from powdered SiC or TiC. In order to adjust the electric resistance and the thermal expansion coefficient, $Al_2O_3$ may be added to this material. A press work is conducted with the granular material charged in the space between the rod-shaped member and a mould and the portions of the granular material other than the portion thereof in the spiral screw-thread groove are removed. Then, the rod-shaped member together with the pressed granular material remaining in the groove is fired temporarily. Then, the end of the rod-shaped member is mechanically processed into the form shown by full-line in FIG. 2*b*. The rod-shaped member is then finally fired to extinguish the binder while contracting the size, thereby to form the heat generating portion 102 in which the ceramic resistor 107 is disposed in the spiral screw-thread groove 109.

In operation, the glow plug is mounted on the cylinder cover of an engine at its mounting portion 101. Then, as a battery is connected between the central electrode 105 and the housing 103, the electric current flows through the central electrode 105 to the ceramic resistor 107, so that the ceramic resistor 107 produces heat to heat up the whole part of the heat generating portion 102 up to the desired high temperature.

According to the arrangement stated above, the ceramic resistor is disposed directly into the atmosphere, so that the heat generating portion can be heated to the desired high temperature in a shorter period of time and a high thermal efficiency is obtained. In addition, the undesirable deterioration and breakdown of the material due to heating to high temperature are avoided advantageously.

Figure 3:
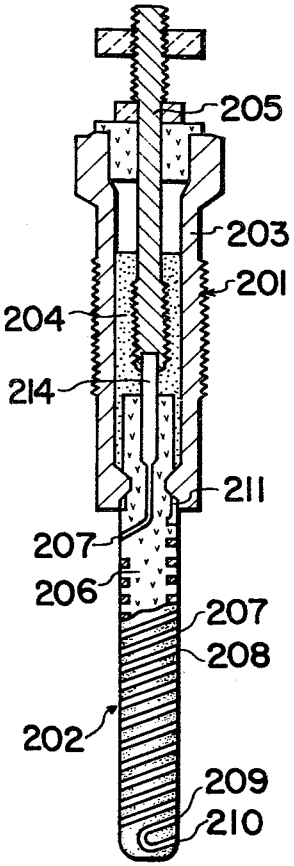
* and FIG. 3 is a vertical sectional view of a glow plug in accordance with another embodiment of the invention.

Referring now to FIG. 3, a glow plug in accordance with another embodiment of the invention has a pair of screw-thread grooves formed in the peripheral surface of a ceramic central rod 206 in the heat genrating portion 202. Ceramic resistors 207 and 208 are embedded in these grooves just under the peripheral surface of the heat generating portion 202. The resistors 207 and 208 are shaped substantially identically to each other. The ceramic central rod 206 and the resistors 207, 208 are made from the same materials as the materials of the central rod 106 and the resistor 107 of the first embodiment. The resistor 207 is connected at its upper end 214 to the central electrode 205, while the resistor 208 is connected at its upper end 211 to the housing 203. The resistor 207 and the resistor 208 are connected directly to each other at their lower ends 209 and 210.

Other portions of the glow plug of this second embodiment are materially identical to those of the first embodiment. In operation, a battery is connected between the central electrode 205 and the housing 203 to supply the resistors 207 and 208 with electric power to generate heat for heating up the heat generating portion 202 as a whole up to the desired high temperature. In the glow plug of the second embodiment, the heating time is further shortened to further enhance the thermal efficiency because the resistors 207 and 208 are laid just beneath the peripheral surface of the heat generating portion 202.

What is claimed is:

1. A glow plug for diesel engines comprising:

a central rod made of alumina as an electrically insulating ceramics material;

a heat generating body attached to the outer peripheral surface of said central rod integrally with said central rod, said heat generating body being made of a mixture material consisting mainly of titanium carbide as a ceramic semiconductor material and alumina added to said titanium carbide;

a heat generating portion including said heat generating body and said central rod; and a mounting portion secured to the outer periphery of said central rod of said heat generating portion;

wherein said heat generating body of said heat generating portion has one end and the other end, said ends constituting connecting portions for connection to electric terminals.

2. A glow plug for diesel engines according to claim 1, wherein at least one spiral groove is formed in the outer peripheral surface of said central rod, said heat generating body being received by said spiral groove so as to be fixed to said central rod integrally with said central rod.

3. A glow plug for diesel engines according to claim 1, wherein said one end of said heat generating body extends through said central rod to project from one end of said central rod so as to be connected to the central electrode of said glow plug while said the other end of said heat generating body is connected to said mounting portion.

* * * * *